US010145225B2

(12) United States Patent
Sanchez et al.

(10) Patent No.: US 10,145,225 B2
(45) Date of Patent: Dec. 4, 2018

(54) LATER STAGE HYDROCARBON PRODUCTION PROCESSES

(71) Applicant: NEXEN ENERGY ULC, Calgary (CA)

(72) Inventors: Julio Sanchez, Calgary (CA); Jason Russell Bruce Dickson, Calgary (CA); Sergio Merchan, Calgary (CA)

(73) Assignee: NEXEN ENERGY ULC, Alberta (CA)

( * ) Notice: Subject to any disclaimer, the term of this patent is extended or adjusted under 35 U.S.C. 154(b) by 362 days.

(21) Appl. No.: 15/205,129

(22) Filed: Jul. 8, 2016

(65) Prior Publication Data

US 2017/0009562 A1 Jan. 12, 2017

Related U.S. Application Data

(60) Provisional application No. 62/191,046, filed on Jul. 10, 2015.

(30) Foreign Application Priority Data

Jul. 10, 2015 (CA) ..... 2896754

(51) Int. Cl.
*E21B 43/24* (2006.01)
*E21B 43/30* (2006.01)
(Continued)

(52) U.S. Cl.
CPC ..... *E21B 43/2406* (2013.01); *E21B 43/20* (2013.01); *E21B 43/2408* (2013.01); *E21B 43/305* (2013.01); *E21B 47/065* (2013.01)

(58) Field of Classification Search
CPC . E21B 43/2406; E21B 43/2408; E21B 47/065
See application file for complete search history.

(56) References Cited

U.S. PATENT DOCUMENTS

2015/0354330 A1* 12/2015 Stahl ..... E21B 43/14 166/254.1

OTHER PUBLICATIONS

Canadian Intellectual Property Office, six month Office Action for CA Application No. 2,896,754 dated Mar. 14, 2016.

(Continued)

*Primary Examiner* — Robert E Fuller
(74) *Attorney, Agent, or Firm* — Norton Rose Fulbright Canada LLP; Paul J. Field

(57) ABSTRACT

A hydrocarbon production process comprising operating a first early stage hydrocarbon production process within a first communication domain with a first well pair, and operating a second early stage hydrocarbon production process within a second communication domain with a second well pair, such that an intermediate reservoir region including stranded bitumen becomes disposed between the first and second communication domains; wherein the first early stage hydrocarbon production process includes injecting a first production-initiating fluid via a first injection well of the first well pair into a first communication domain such that hydrocarbon material is mobilized and conducted to a first production well of the first well pair, and producing the received hydrocarbon material via the first production well; and wherein the second early stage hydrocarbon production process includes injecting a second production-initiating fluid via a second injection well of the second well pair into a second communication domain such that hydrocarbon material is mobilized and conducted to a second production well of the second well pair, and producing the received hydrocarbon material via the second production well; selecting a pre-selected zone within the reservoir, wherein the selecting is based upon temperature fall-off data within the first and second communication zones; and positioning a portion of an infill well within the pre-selected zone for (Continued)

receiving mobilized hydrocarbon material of at least the intermediate reservoir region and for producing the received hydrocarbon material.

20 Claims, 6 Drawing Sheets

(51) Int. Cl.
*E21B 43/20* (2006.01)
*E21B 47/06* (2012.01)

(56) References Cited

OTHER PUBLICATIONS

Canadian Intellectual Property Office, three month Office Action for CA Application No. 2,896,754 dated Mar. 14, 2016.

* cited by examiner

LATER STAGE HYDROCARBON PRODUCTION PROCESSES

FIELD

The present disclosure relates to improvements in production of hydrocarbon-comprising material from hydrocarbon-bearing reservoirs.

BACKGROUND

Thermal enhanced oil recovery methods are used to recover bitumen and heavy oil from hydrocarbon reservoirs. The most dominant of these methods is steam-assisted gravity drainge ("SAGD"). However, SAGD operations typically leave behind significant quantities of residual bitumen within the reservoir, as the gravity drainage mechanism becomes inefficient during later stages of the operation, especially with respect to bitumen that is disposed remotely relative to the SAGD well pair.

SUMMARY

In one aspect of the invention there is provided a hydrocarbon production process comprising: operating an early stage hydrocarbon production process with a first well pair within a reservoir, wherein the early stage hydrocarbon production process includes injecting a production-initiating fluid via an injection well of the first well pair into a communication domain such that hydrocarbon material is mobilized and conducted to a production well of the first well pair, and producing the mobilized hydrocarbon, that has been received by the production well, via the production well; selecting a pre-selected zone within the reservoir based upon temperature fall-off data within the communication domain; and positioning a portion of an infill well within the pre-selected zone for receiving mobilized hydrocarbon material of at least a flanking region, that is spaced apart from and flanking the communication domain, and for producing the received hydrocarbon material.

In another aspect of the invention, there is provided a hydrocarbon production process comprising: operating a first early stage hydrocarbon production process within a first communication domain with a first well pair, and operating a second early stage hydrocarbon production process within a second communication domain with a second well pair, such that an intermediate reservoir region including stranded bitumen becomes disposed between the first and second communication domains; wherein the first early stage hydrocarbon production process includes injecting a first production-initiating fluid via a first injection well of the first well pair into a first communication domain such that hydrocarbon material is mobilized and conducted to a first production well of the first well pair, and producing the received hydrocarbon material via the first production well; and wherein the second early stage hydrocarbon production process includes injecting a second production-initiating fluid via a second injection well of the second well pair into a second communication domain such that hydrocarbon material is mobilized and conducted to a second production well of the second well pair, and producing the received hydrocarbon material via the second production well; selecting a pre-selected zone within the reservoir, wherein the selecting is based upon temperature fall-off data within the first and second communication zones; and positioning a portion of an infill well within the pre-selected zone for receiving mobilized hydrocarbon material of at least the intermediate reservoir region and for producing the received hydrocarbon material.

BRIEF DESCRIPTION OF DRAWINGS

Embodiments will now be described, by way of example only, with reference to the attached figures, wherein.

DETAILED DESCRIPTION

The present disclosure relates to use of a production-initiating fluid for effecting production of hydrocarbon material from a hydrocarbon-containing reservoir 10 disposed below the earth's surface 12.

As used herein, the following terms have the following meanings:

"Hydrocarbon" is an organic compound consisting primarily of hydrogen and carbon, and, in some instances, may also contain heteroatoms such as sulfur, nitrogen and oxygen.

"Hydrocarbon material" is material that consists of one or more hydrocarbons.

"Heavy hydrocarbon material" is material that consists of one or more heavy hydrocarbons. A heavy hydrocarbon is a hydrocarbon that, at conditions existing with the hydrocarbon-containing reservoir, has a an API gravity of less than 26 degrees and a viscosity of greater than 20,000 centipoise. An exemplary heavy hydrocarbon material is bitumen.

A well, or sections of a well, can be characterized as "vertical" or "horizontal" even though the actual axial orientation can vary from true vertical or true horizontal, and even though the axial path can tend to "corkscrew" or otherwise vary. The term "horizontal", when used to describe a section of a wellbore, refers to a horizontal or highly deviated wellbore section as understood in the art, such as, for example, a wellbore section having a longitudinal axis that is between 70 and 110 degrees from vertical.

(a) Recovery of Hydrocarbon Material from a Region that is Flanking a Communication Domain Between a Well Pair.

Figure 1:
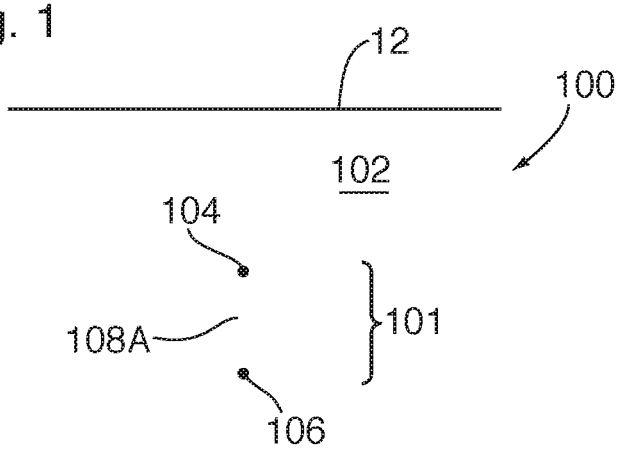
FIG. 1 is a schematic illustration of an embodiment of a system for implementing steam assisted gravity drainage ("SAGD") for producing hydrocarbon material from a reservoir.

Referring to FIG. 1, there is provided a system 100 for carrying out a process for producing hydrocarbon material from a hydrocarbon-containing reservoir 102. In some embodiments, for example, the hydrocarbon-containing reservoir includes an oil sands reservoir, and the hydrocarbon material includes heavy hydrocarbon material, such as bitumen.

The system 100 includes a well pair 101. The well pair 101 includes a pair of wells 104, 106. Each one of the wells 104, 106, independently, includes a respective horizontal section. The well 104 functions as an injection well and the well 106 functions as a production well. The injection well 104 injects production-initiating fluid to effect production of the hydrocarbon material via the production well 106.

A hydrocarbon production process may be implemented via the well pair 101, so long as fluid communication is effected between the wells 104, 106 via a communication domain 109A (i.e. fluid is conductible (for example, by flowing)) such that the injected production-initiating fluid effects mobilization of the hydrocarbon material within the reservoir, and the mobilized hydrocarbon material is conducted to the production well 106 via the communication domain 109A for production via the production well 106. The conduction of the hydrocarbon material to the production well 106 is effected in response to an applied driving force (for example, application of a fluid pressure differential, or gravity, or both). In some embodiments, for example, the production-initiating fluid functions as a drive fluid effecting conduction (or transport) of hydrocarbon material to the production well 106. In some embodiments, for example, the production-initiating fluid functions as a heat transfer fluid, supplying heat to the hydrocarbon material, such that viscosity of the hydrocarbon material is sufficiently reduced (in such state, the hydrocarbon material is said to be mobilized), such that the hydrocarbon material may be conducted to the production well 106 by a driving force, such as, for example, a pressure differential or gravity. In some embodiments, for example, the production-initiating fluid functions as both a drive fluid and a heating fluid. While the wells 104, 106 are disposed in fluid communication through the communication domain 109A, production-initiating fluid is injected into the reservoir 102 such that the hydrocarbon material is conducted to the well 106, via the communication domain 109A, and produced through the well 106. In some embodiments, for example, the hydrocarbon material that is received by the well 106 is produced via the well 106 by artificial lift.

In some embodiments, for example, and as alluded to above, the hydrocarbon material may be highly viscous (such as, for example, in the case of heavy hydrocarbon material, such as bitumen), and may require pre-conditioning prior to the implementation of the hydrocarbon production process, such that the hydrocarbon material is conductible (e.g. by flowing) to the production well in response to application of a driving force. In this respect, in some embodiments, for example, hydrocarbon material within an interwell region 108A, between wells 104, 106, is pre-conditioned so as to effect a reduction in the viscosity of the hydrocarbon material, such that interwell communication is established after the pre-conditioning. In some embodiments, for example, the pre-conditioning includes heating.

In some embodiments, for example, the hydrocarbon production process includes a thermally-actuated gravity drainage-based hydrocarbon production process that is implemented via the well pair 101. In such embodiments, the horizontal section of the well 104 is vertically spaced from the horizontal section of the well 106, such that the horizontal section of the well 104 is disposed above the horizontal section of the well 106, such as, for example, by at least three (3) metres, such as, for example, by at least five (5) metres. In some embodiments, for example, the production-initiating fluid includes steam. A production phase (i.e. when hydrocarbon material is being produced via the well 106) of the thermally-actuated gravity drainage-based hydrocarbon production process occurs after interwell communication has been established, through the interwell region 108A, between the wells 104, 106. "Interwell communication", in the context of a thermally-actuated gravity drainage-based hydrocarbon production process, describes a condition of the reservoir which permits hydrocarbon material within the reservoir 102, mobilized by heat supplied from the injected production-initiating fluid that is injected via the injection well 104, to be conducted, by at least gravity drainage, to the production well 106. In this respect, the interwell communication is established when the injected production-initiating fluid is able to communicate heat to hydrocarbon material within the reservoir such that the hydrocarbon material is mobilized, and the mobilized hydrocarbon material is then conducted, by at least gravity, through the interwell region 108A, to the production well 106.

Figure 2:
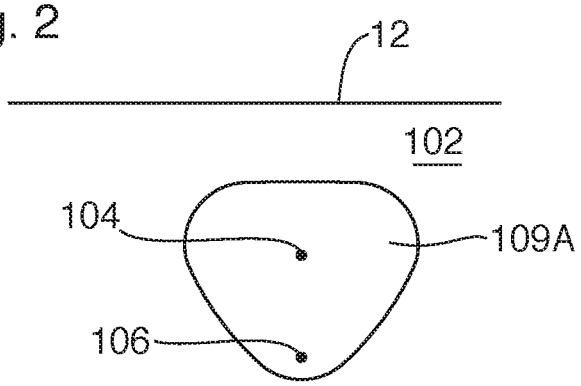
FIG. 2 is a schematic illustration of a steam chamber that has developed by operating a SAGD process using the system illustrated in FIG. 1.

With respect to thermally-actuated gravity drainage-based hydrocarbon production processes being implemented via the well pair 101, in some of these embodiments, for example, initially, the reservoir 102 has relatively low fluid mobility (such as, for example, due to the fact that the hydrocarbon material within the reservoir 102 is highly viscous) such that interwell communication is not present. In order to enable the injected production-initiating fluid (being injected through the injection well 104) to promote the conduction of the reservoir hydrocarbons, within the reservoir 102, to the production well 106, the interwell communication must be established between the wells 104, 106 through the interwell region 108A. This communication may be established during a "start-up" phase of the thermally-actuated gravity drainage-based hydrocarbon production process. During the start-up phase, the interwell region 108A is heated. In some embodiments, for example, the heat is supplied to the interwell region 108A by circulating a start-up phase fluid (such as steam, or a fluid including steam) through one or both of the wells 104, 106. The heat that is supplied to the interwell region 108A heats the reservoir hydrocarbons within the interwell region 108A, thereby reducing the viscosity of the reservoir hydrocarbons. Eventually, the interwell region 108A becomes heated to a temperature such that the hydrocarbon material is sufficiently mobile (i.e. the hydrocarbon material has been "mobilized") for displacement to the production well 106 by at least gravity drainage. Referring to FIG. 2, in this respect, eventually, sufficient hydrocarbon material becomes mobilized, such that space previously occupied by immobile, or substantially immobile, hydrocarbon material is able to communicate fluid between the injection well 106 and the production well 106 in response to a driving force, such that at least hydrocarbon material is conductible through this space in response to the driving force, and this space defines the communication domain 109A. The development of the communication domain 109A signals completion of the start-up phase and conversion to a production phase.

During the production phase of a thermally-actuated gravity drainage-based hydrocarbon production process, the communication domain 109A effects fluid communication between the production-initiating fluid, being injected through the injection well 104, with hydrocarbon material within the reservoir, such that the injected production-initiating fluid is conducted through the communication domain 109A and becomes disposed in heat transfer communication with hydrocarbon material within the reservoir such that the hydrocarbon material becomes heated. When sufficiently heated such that its viscosity becomes sufficiently reduced, the hydrocarbon material becomes mobilized, and, in this respect, the hydrocarbon material is able to be conducted, by at least gravity drainage (the conduction may also, for example, be promoted by a pressure differential that is established between the injected production initiating fluid and the production well 106, which may also, in some embodiments, be characterized as a "drive process" mechanism), through the communication domain 109A, to the production well 106, and subsequently produced from the production well 106 by artificial lift, such as by a pump. During the production phase, while the production-initiating fluid is being injected into the communication domain 109A via the injection well 104, as the mobilized hydrocarbon material drains to the production well 106, space previously occupied by the hydrocarbon material within the reservoir becomes occupied by the injected production-initiating fluid, thereby exposing a fresh hydrocarbon material surface for receiving heat from the production-initiating fluid (typically, by conduction). This repeated cycle of heating, mobilization, drainage, and establishment of heat transfer communication between the production-initiating fluid and a freshly exposed hydrocarbon material source results in the growth of the communication domain 109A, with the freshly exposed hydrocarbon material being disposed along an edge of the communication domain 109A. In some embodiments, for example, the communication domain 109A includes a "vapour chamber". In some embodiments, for example, the vapour chamber may also be referred to as a "steam chamber". In some embodiments, for example, the growth of the communication domain 109A is upwardly, laterally, or both, and, typically, extends above the horizontal section of the injection well 104.

In some embodiments, for example, where, in implementing the thermally-actuated gravity drainage-based process, the production-initiating fluid includes steam, the process that is effecting this production is described as "steam-assisted gravity drainage" or "SAGD". In some embodiments, for example, the communication domain 109A includes a vapour chamber, such as, for example, a "steam chamber". During SAGD, the conduction of the mobilized hydrocarbon material to the production well 106 is accompanied by condensed steam (i.e. water), whose condensation is effected by at least heat loss to the hydrocarbon material (which effects the mobilization of the hydrocarbon material).

Figure 3:
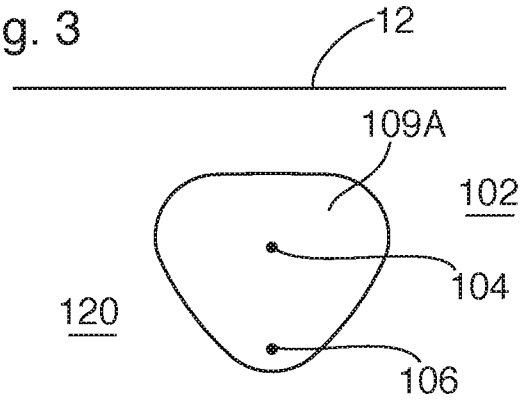
FIG. 3 is a schematic illustration of a flanking region that is disposed adjacent to the steam chamber illustrated in FIG. 2.

As described above, during the hydrocarbon production process, the production-initiating fluid, being injected through the injection well 104, effects mobilization of hydrocarbon material. Although some of this hydrocarbon material becomes mobilized and produced, some of it is not. Referring to FIG. 3, during the hydrocarbon production process, some of this hydrocarbon material may become stranded within a flanking region 120 that is spaced apart from and flanking the communication domain 109A, and requires significant investment of heat energy to effect its recovery from this flanking region 120 and production via the well 106. At least a portion of the flanking region 120 is heated by at least heat that is communicated from the production-initiating fluid being injected into the reservoir 102 (such as, for example, into the communication domain 109A).

Figure 4:
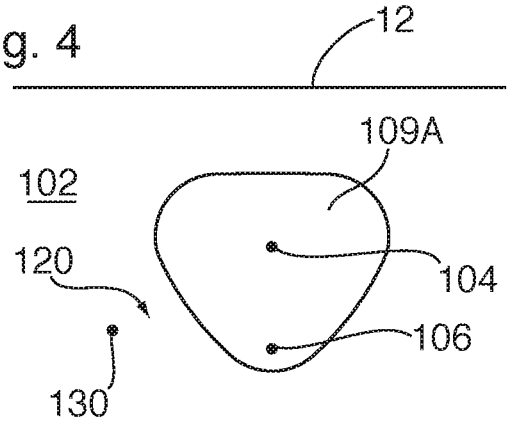
FIG. 4 is a schematic illustration of a step-out well that has been positioned within the flanking region illustrated in FIG. 3.
Figure 4A:
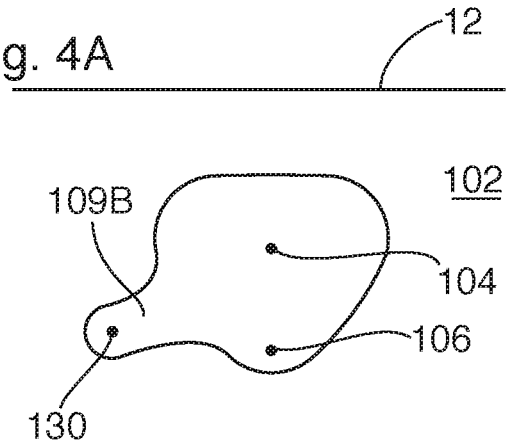
FIG. 4A is a schematic illustration of further development of the steam chamber illustrated in FIG. 2 such that the steam chamber has extended into the flanking region illustrated in FIG. 3.

It is desirable to recover the hydrocarbon material disposed within the flanking region. To do so, and referring to FIG. 4, after an early stage hydrocarbon production process (such as, for example, an early thermally-actuated gravity drainage-based process) has been being effected for a period of time, an infill well 130 is formed (in some embodiments, for example, the forming includes drilling) for receiving mobilized hydrocarbon material of at least a flanking region, that is spaced apart from and flanking the communication domain, and for producing the received hydrocarbon material. In some embodiments, for example, the hydrocarbon material that is received by the infill well 130 is produced via the well 130 by artificial lift. In some embodiments, for example, the infill well 130 is formed after the early stage hydrocarbon production process has been suspended. In some embodiments, for example, the infill well 130 is a step-out well. In some embodiments, for example, the infill well 130 includes a respective horizontal section for receiving gravity drainage of hydrocarbon material whose mobilization has been effected by production-initiating fluid that has been injected via the injection well 104 that is disposed above the infill well 130.

In some embodiments, for example, a later stage hydrocarbon production process may be implemented via the infill well 130. In some embodiments, for example, prior to the formation of the infill well, and up until at least the implementation of a later stage hydrocarbon production process via the infill well 130, the injecting of production-initiating fluid into the communication domain 109A is suspended.

In some embodiments, for example, the later-stage hydrocarbon production process may include cyclic steam stimulation. In this respect, steam is injected into the flanking region 120 via the infill well 130, time is provided for heat to be transferred to the hydrocarbon material in order to effect the viscosity reduction such that the hydrocarbon material becomes mobilized, and then the infill well 130 is converted to a production well and the mobilized hydrocarbon material is produced via the infill well 130.

In some embodiments, for example, the later-stage hydrocarbon production process may include SAGD. In such cases, once fluid communication is effected between the injection well 104A and the infill well 130 (such as by, for example, injecting steam into the flanking region 120 so as to effect the sufficient mobilization of the hydrocarbon material within the flanking region such that interwell fluid communication becomes effected between the injection well 104A and the infill well 130), steam is injected into the flanking region 130 via the injection well 104A such that production of hydrocarbon material is effected by a combination of at least a drive mechanism and a gravity drainage mechanism. The continued injection of steam contributes to the development of a communication domain (or steam chamber) 109B (as an extension of the communication domain 109A), much in the same way as the development of the communication domain 109A. It is understood that, as a necessary incident to some implementations of the process, hydrocarbon material from within the communication domain 109A may also become mobilized by the steam injected via the injection well 104A, then conducted to the infill well 130 (by at least gravity drainage), and then produced via the infill well 130.

It is understood that the selection of the later-stage hydrocarbon production process is independent of the selection of the early stage hydrocarbon production process, and that the type of hydrocarbon production process implemented as the later-stage hydrocarbon production process may be the same as, or different than, the early stage hydrocarbon production process. For example, in some embodiments, the early stage hydrocarbon production process may be SAGD, while the later-stage hydrocarbon production process may be cyclic steam stimulation. Alternatively, in some embodiments, both of the early stage hydrocarbon production process and the later-stage hydrocarbon production process may be a SAGD process.

Figure 5:
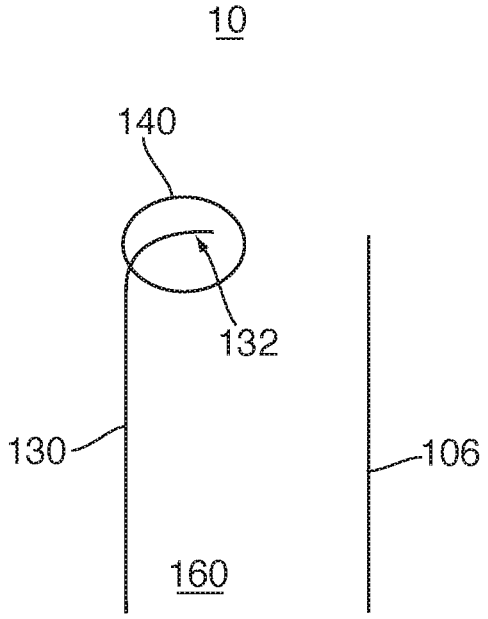
FIG. 5 is a plan view of the relative positioning of the infill well well vis-à-vis the production well of the SAGD well pair, illustrating disposition of the pre-selected zone-disposed portion of the infill well within a pre-selected zone.
Figure 6:
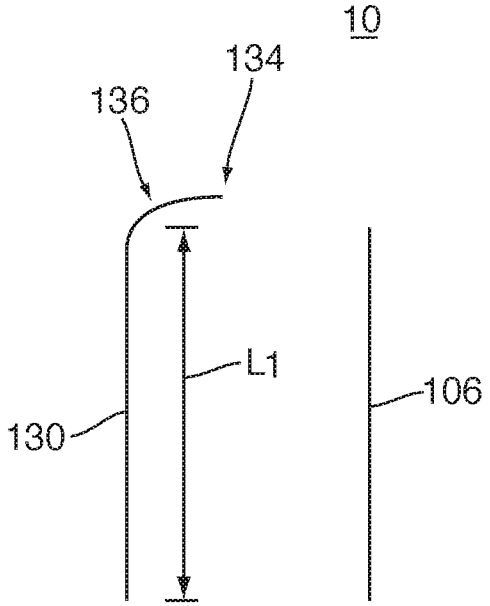
FIG. 6 is another plan view of the relative positioning of the infill well vis-à-vis the production well of the SAGD well pair, illustrating disposition of the pre-selected zone-disposed portion of the infill well within a pre-selected zone, and further illustrating positioning of other portions of the infill well relative to the pre-selected zone-disposed portion.

Referring to FIG. 5, in forming the infill well 130, the infill well becomes positioned such that a pre-selected zone-disposed portion 132 of the infill well is disposed within a pre-selected zone 140 within the reservoir 10. In some embodiments, for example, the positioning includes drilling. In some embodiments, for example, the positioning may include modification to, or extension of, a pre-existing well.

In some embodiments, for example, the pre-selected zone-disposed portion 132 of the infill well 130 is defined at, or substantially at, the toe 134 of the infill well 130. In some embodiments, for example, the pre-selected zone-disposed portion 132 of the infill well 130 is defined within a hook portion 136 of the infill well 130. In some embodiments, for example, the hook portion 136 is oriented in a direction towards the production well 106.

In some embodiments, for example, the selecting is based upon a plurality of temperature determinations, wherein each one of the temperature determinations is, independently, respective to one of a corresponding plurality of zones within the reservoir 102. In some embodiments, for example, the process further includes obtaining temperatures within each one of the plurality of zones within the reservoir 102.

In some embodiments, for example, the selecting is based upon a determination that the pre-selected zone 140 is disposed at a higher temperature than the other ones of the two or more zones. In some embodiments, for example, each one of the two or more zones, independently, is disposed externally of the communication domain 109A. In some embodiments, for example, each one of the two or more zones, independently, is disposed within the flanking region 120. In some embodiments, for example, the infill well is disposed within the flanking region 120. In some embodiments, for example, the process further includes sensing temperature within a plurality of zones within the reservoir for effecting the determination that the pre-selected zone 140 is disposed at a higher temperature than the other ones of the two or more zones.

In some embodiments, the pre-selected zone 140 is selected from two or more zones within the reservoir 102, wherein the selecting is based upon a determination that the pre-selected zone has a rate of cooling that is slower than the other ones of the two or more zones. In some embodiments, for example, each one of the two or more zones, independently, is disposed externally of the communication domain 109A. In some embodiments, for example, each one of the two or more zones, independently, is disposed within the flanking region. In some embodiments, for example, the infill well is disposed within the flanking region 120. In some embodiments, for example, the process further includes sampling for temperature fall-off data upon which the determination is based.

In some embodiments, for example, the selection of the pre-selected zone 140 is based upon temperature fall-off data of the communication zone 109A. Temperature fall-off data may be obtained by shutting in the injection well 104 such that the communication domain 109A is permitted to cool. In some embodiments, for example, the disposition of the pre-selected zone-disposed portion 132 of the infill well 130 is within the flanking region 120. In some embodiments, for example, the pre-selected zone is selected externally of the communication domain 109A. In some embodiments, for example, the process further includes sampling for temperature fall-off data upon which the selecting is based.

In some embodiments, for example, the infill well includes a horizontal section, and the pre-selected zone-disposed portion is disposed within the horizontal section.

In some embodiments, for example, the selecting is such that, after the infill well portion 132 becomes disposed within the pre-selected zone 140, the pre-selected zone-disposed portion 132 of the infill well 130 is closer to the production well 106 than is at least 75% of the axial length "L1" (such as, for example, at least 90% of the axial length L1) of the horizontal section of the infill well. In some embodiments, for example, at least 75% of the axial length of the horizontal section of the infill well 130 that is other than the pre-selected zone-disposed portion 132 of the infill well 130, the minimum distance, by which each one of the portions of the at least 75% of the axial length of the horizontal section of the infill well, independently, is spaced apart from a respective production well of one of the well pairs, is greater than the minimum distance by which the pre-selected zone-disposed portion of the infill well is spaced apart from that production well 106 by at least 10%, such as, for example, at least 25% such as, for example, at least 50%. It is understood that the at least 75% of the axial length of the horizontal section of the infill well 130 that is other than the pre-selected zone-disposed portion 132 of the infill well 130 may be a continuous sub-section or may include a plurality of spaced-apart sub-sections.

In some embodiments, for example, in being produced through the infill well 130, the hydrocarbon material is conducted via a wellbore fluid conductor (e.g. conduit), disposed within the infill well 130, to the surface. In this respect, the wellbore fluid conductor functions to effect conduction of heat from the pre-selected zone to a heat receiving zone 160 of the flanking region 120. In this respect, in some embodiments, for example, heat communicated from the pre-selected zone 140, and received by the wellbore fluid conductor, that is disposed within the infill well 130, sufficiently contributes to the heating of a heat receiving zone 160 of the flanking region 120. In some of these embodiments, for example, the selecting is based upon a determination that, after the infill well portion 132 becomes disposed within the pre-selected zone 140, sufficient heat is communicated from the pre-selected zone 140, via the infill well 132, for at least contributing to the heating of one or more heat receiving zones 160 of the flanking region 120 such that hydrocarbon material within the flanking region 120 becomes mobilized in the absence of heat communicated from fluid injected into the flanking region 120 after the infill well portion 132 becomes disposed within the pre-selected zone 140. In some embodiments, for example, the absence of heat communicated from fluid injected into the flanking region 120 after the infill well portion 132 becomes disposed within the pre-selected zone 140 includes the absence of heat communicated from fluid injected into the flanking region 120 via the infill well 130.

On the other hand, in some embodiments, for example, prior to producing hydrocarbon material with the later-stage hydrocarbon production process, additional heating of the flanking region 120 may be necessary to effect mobilization of hydrocarbon material within the flanking region 120, and, in some of these embodiments (such as in those embodiments where it is intended to implement a thermally-actuated gravity drainage-based hydrocarbon production process), effect interwell communication between the infill well 130 and the injection well 104, and thereby extend the communication domain 109A into the communication domain 109B. In this respect, in some embodiments, for example, the heating may be effected by injecting heating fluid (such as a production-initiating fluid) into the flanking region 120 via the infill well 130.

Figure 7:
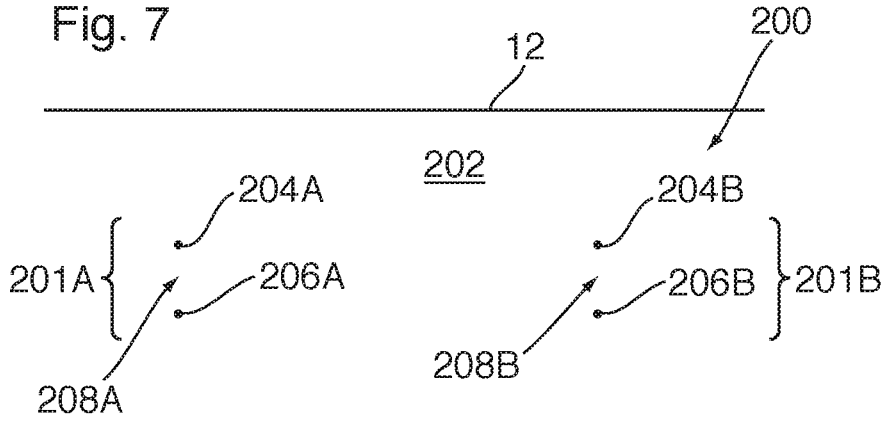
FIG. 7 is a schematic illustration of an embodiment of a system for implementing steam assisted gravity drainage ("SAGD") for producing hydrocarbon material from a reservoir using adjacent well pairs.

(b) Recovery of Hydrocarbon Material from a Region that is Disposed Between a Pair of Communication Domains Referring to FIG. 7, there is provided a system 200 for carrying out a process for producing hydrocarbon material from a hydrocarbon-containing reservoir 202 disposed below the earth's surface 12. In some embodiments, for example, the hydrocarbon-containing reservoir includes an oil sands reservoir, and the hydrocarbon material includes heavy hydrocarbon material, such as bitumen.

The system 200 includes two sets 201A, 201B of well pairs. Referring to FIG. 2, the first set 201A includes a pair of wells 204A, 206A, and the second set includes a pair of wells 204B, 206B. For the first set 201A, the well 204A functions as a first injection well and the well 206A functions as a first production well. An interwell region 208A is disposed between the wells 204A, 206A. Each one of the wells 204A, 206A, independently, includes a respective horizontal section, and the horizontal section of the well 204A is vertically spaced from the horizontal section of the well 206A, such that the horizontal section of the well 204A is vertically higher than the horizontal section of the well 206A. Referring to FIG. 3, for the second set 201B of well pairs, the well 204B functions as a second injection well and the well 206B functions as a second production well. An interwell region 208B is disposed between the wells 204B, 206B. Each one of the wells 204B, 206B, independently, includes a respective horizontal section, and the horizontal section of the well 204B is vertically spaced from the horizontal section of the well 206B, such that the horizontal section of the well 204B is disposed above the horizontal section of the well 206B, such as, for example, by at least three (3) metres, such as, for example, by at least five (5) metres.

Figure 8:
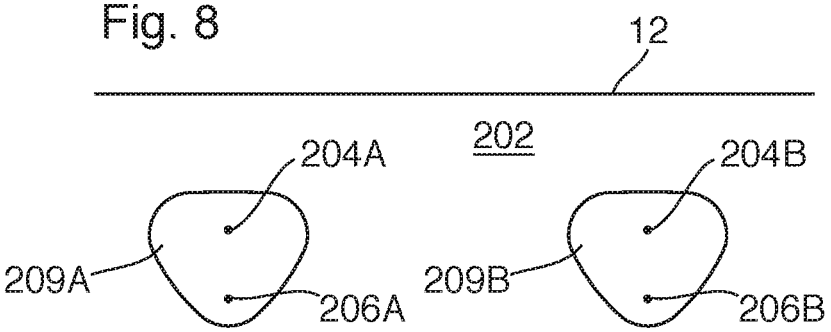
FIG. 8 is a schematic illustration of steam chambers that have developed by operating SAGD processes using the system illustrated in FIG. 7.

Referring to FIG. 8, a first early stage hydrocarbon production process may be implemented via the first set 201A of well pairs, and such process is said to be respective to the first set 201A of well pairs. The first early stage hydrocarbon production process includes injecting a first production-initiating fluid via the first injection well 204A of the first well pair into a first communication domain 209A such that hydrocarbon material is mobilized and conducted to the first production well 206A of the first well pair, and producing the received hydrocarbon material via the first production well 206A.

As well, a second early stage hydrocarbon production process may be implemented via the second set 201B of well pairs, and such process is said to be respective to the second set 201B of well pairs. The second early stage hydrocarbon production process includes injecting a second production-initiating fluid via the second injection well 204B of the second well pair into a second communication domain 209B such that hydrocarbon material is mobilized and conducted to the second production well 206B of the second well pair, and producing the received hydrocarbon material via the second production well 206B.

A hydrocarbon production process may be implemented via the well pair 201A, so long as fluid communication is effected between the wells 204A, 206A via a communication domain 209A (i.e. fluid is conductible (for example, by flowing)) such that the injected production-initiating fluid effects mobilization of the hydrocarbon material within the reservoir, and the mobilized hydrocarbon material is conducted to the production well 206A via the communication domain 209A for production via the production well 206A. The conduction of the hydrocarbon material to the production well 206A is effected in response to an applied driving force (for example, application of a fluid pressure differential, or gravity, or both). In some embodiments, for example, the production-initiating fluid functions as a drive fluid effecting conduction (or transport) of hydrocarbon material to the production well 206A. In some embodiments, for example, the production-initiating fluid functions as a heat transfer fluid, supplying heat to the hydrocarbon material, such that viscosity of the hydrocarbon material is sufficiently reduced (in such state, the hydrocarbon material is said to be mobilized), such that the hydrocarbon material may be conducted to the production well 206A by a driving force, such as, for example, a pressure differential or gravity. In some embodiments, for example, the production-initiating fluid functions as both a drive fluid and a heating fluid. While the wells 204A, 206A are disposed in fluid communication through the communication domain 209A, production-initiating fluid is injected into the reservoir 202 such that the hydrocarbon material is conducted to the well 206A, via the communication domain 209A, and produced through the well 206A. In some embodiments, for example, the hydrocarbon material that is received by the well 206A is produced via the well 206A by artificial lift.

In some embodiments, for example, and as alluded to above, the hydrocarbon material may be highly viscous (such as, for example, in the case of heavy hydrocarbon material, such as bitumen), and may require pre-conditioning prior to the implementation of the hydrocarbon production process, such that the hydrocarbon material is conductible (e.g. by flowing) to the production well in response to application of a driving force. In this respect, in some embodiments, for example, hydrocarbon material within an interwell region 208A, between wells 204A, 206A, is pre-conditioned so as to effect a reduction in the viscosity of the hydrocarbon material, such that interwell communication is established after the pre-conditioning. In some embodiments, for example, the pre-conditioning includes heating.

Similarly, a hydrocarbon production process may be implemented via the well pair 201B, so long as fluid communication is effected between the wells 204B, 206B via a communication domain 209B (i.e. fluid is conductible (for example, by flowing)) such that the injected production-initiating fluid effects mobilization of the hydrocarbon material within the reservoir, and the mobilized hydrocarbon material is conducted to the production well 206B via the communication domain 209B for production via the production well 206B. The conduction of the hydrocarbon material to the production well 206B is effected in response to an applied driving force (for example, application of a fluid pressure differential, or gravity, or both). In some embodiments, for example, the production-initiating fluid functions as a drive fluid effecting conduction (or transport) of hydrocarbon material to the production well 206B. In some embodiments, for example, the production-initiating fluid functions as a heat transfer fluid, supplying heat to the hydrocarbon material, such that viscosity of the hydrocarbon material is sufficiently reduced (in such state, the hydrocarbon material is said to be mobilized), such that the hydrocarbon material may be conducted to the production well 206B by a driving force, such as, for example, a pressure differential or gravity. In some embodiments, for example, the production-initiating fluid functions as both a drive fluid and a heating fluid. While the wells 204, 206 are disposed in fluid communication through the communication domain 209B, production-initiating fluid is injected into the reservoir 202 such that the hydrocarbon material is conducted to the well 206B, via the communication domain 209B, and produced through the well 206B. In some embodiments, for example, the hydrocarbon material that is received by the well 206B is produced via the well 206B by artificial lift.

In some embodiments, for example, and as alluded to above, the hydrocarbon material may be highly viscous (such as, for example, in the case of heavy hydrocarbon material, such as bitumen), and may require pre-conditioning prior to the implementation of the hydrocarbon production process, such that the hydrocarbon material is conductible (e.g. by flowing) to the production well in response to application of a driving force. In this respect, in some embodiments, for example, hydrocarbon material within an interwell region 208B, between wells 204B, 206B, is pre-conditioned so as to effect a reduction in the viscosity of the hydrocarbon material, such that interwell communication is established after the pre-conditioning. In some embodiments, for example, the pre-conditioning includes heating.

In some embodiments, for example, the hydrocarbon production process includes a thermally-actuated gravity drainage-based hydrocarbon production process. The following is a description of a thermally-actuated gravity drainage-based hydrocarbon production process, that may be implemented via the first set 201A of well pairs, but it is understood that this description is also applicable to implementation of a thermally-actuated gravity drainage-based hydrocarbon production process via the second set 201B of well pairs, using corresponding features associated with the second set 201B of well pairs.

In those embodiments where the hydrocarbon production process includes a thermally-actuated gravity drainage-based hydrocarbon production process, for example, the horizontal section of the well 204A is vertically spaced from the horizontal section of the well 206A, such that the horizontal section of the well 204A is disposed above the horizontal section of the well 206A, such as, for example, by at least three (3) metres, such as, for example, by at least five (5) metres. In some embodiments, for example, the production-initiating fluid includes steam. A production phase (i.e. when hydrocarbon material is being produced via the well 206A) of the thermally-actuated gravity drainage-based hydrocarbon production process occurs after interwell communication has been established, through the interwell region 208A, between the wells 204A, 206A. "Interwell communication", in the context of a thermally-actuated gravity drainage-based hydrocarbon production process, describes a condition of the reservoir which permits hydrocarbon material within the reservoir 202, mobilized by heat supplied from the injected production-initiating fluid that is injected via the injection well 204, to be conducted, by at least gravity drainage, to the production well 206A. In this respect, the interwell communication is established when the injected production-initiating fluid is able to communicate heat to hydrocarbon material within the reservoir such that the hydrocarbon material is mobilized, and the mobilized hydrocarbon material is then conducted, by at least gravity, through the interwell region 208A, to the production well 206A.

With respect to thermally-actuated gravity drainage-based hydrocarbon production processes being implemented via the well pair 201A, in some of these embodiments, for example, initially, the reservoir 202 has relatively low fluid mobility (such as, for example, due to the fact that the hydrocarbon material within the reservoir 202 is highly viscous) such that interwell communication is not present. In order to enable the injected production-initiating fluid (being injected through the injection well 204A) to promote the conduction of the reservoir hydrocarbons, within the reservoir 202, to the production well 206A, the interwell communication must be established between the wells 204A, 206A through the interwell region 208A. This communication may be established during a "start-up" phase of the thermally-actuated gravity drainage-based hydrocarbon production process. During the start-up phase, the interwell region 208A is heated. In some embodiments, for example, the heat is supplied to the interwell region 208A by circulating a start-up phase fluid (such as steam, or a fluid including steam) through one or both of the wells 204A, 206A. The heat that is supplied to the interwell region 208A heats the reservoir hydrocarbons within the interwell region 208A, thereby reducing the viscosity of the reservoir hydrocarbons. Eventually, the interwell region 208A becomes heated to a temperature such that the hydrocarbon material is sufficiently mobile (i.e. the hydrocarbon material has been "mobilized") for displacement to the production well 206A by at least gravity drainage. Referring to FIG. 2, in this respect, eventually, sufficient hydrocarbon material becomes mobilized, such that space previously occupied by immobile, or substantially immobile, hydrocarbon material is able to communicate fluid between the injection well 206A and the production well 206A in response to a driving force, such that at least hydrocarbon material is conductible through this space in response to the driving force, and this space defines the communication domain 209A. The development of the communication domain 209A signals completion of the start-up phase and conversion to a production phase.

During the production phase of a thermally-actuated gravity drainage-based hydrocarbon production process, the communication domain 209A effects fluid communication between the production-initiating fluid, being injected through the injection well 204A, with hydrocarbon material within the reservoir, such that the injected production-initiating fluid is conducted through the communication domain 209A and becomes disposed in heat transfer communication with hydrocarbon material within the reservoir such that the hydrocarbon material becomes heated. When sufficiently heated such that its viscosity becomes sufficiently reduced, the hydrocarbon material becomes mobilized, and, in this respect, the hydrocarbon material is able to be conducted, by at least gravity drainage (the conduction may also, for example, be promoted by a pressure differential that is established between the injected production initiating fluid and the production well 206A, which may also, in some embodiments, be characterized as a "drive process" mechanism), through the communication domain 209A, to the production well 206, and subsequently produced from the production well 206A by artificial lift, such as by a pump. During the production phase, while the production-initiating fluid is being injected into the communication domain 209A via the injection well 204A, as the mobilized hydrocarbon material drains to the production well 206A, space previously occupied by the hydrocarbon material within the reservoir becomes occupied by the injected production-initiating fluid, thereby exposing a fresh hydrocarbon material surface for receiving heat from the production-initiating fluid (typically, by conduction). This repeated cycle of heating, mobilization, drainage, and establishment of heat transfer communication between the production-initiating fluid and a freshly exposed hydrocarbon material source results in the growth of the communication domain 209A, with the freshly exposed hydrocarbon material being disposed along an edge of the communication domain 209A. In some embodiments, for example, the communication domain 209A includes a "vapour chamber". In some embodiments, for example, the vapour chamber may also be referred to as a "steam chamber". In some embodiments, for example, the growth of the communication domain 209A is upwardly, laterally, or both, and, typically, extends above the horizontal section of the injection well 204A.

In some embodiments, for example, where, in implementing the thermally-actuated gravity drainage-based process, the production-initiating fluid includes steam, the process that is effecting this production is described as "steam-assisted gravity drainage" or "SAGD". In some embodiments, for example, the communication domain 209A includes a vapour chamber, such as, for example, a "steam chamber". During SAGD, the conduction of the mobilized hydrocarbon material to the production well 206A is accompanied by condensed steam (i.e. water), whose condensation is effected by at least heat loss to the hydrocarbon material (which effects the mobilization of the hydrocarbon material).

Figure 9:
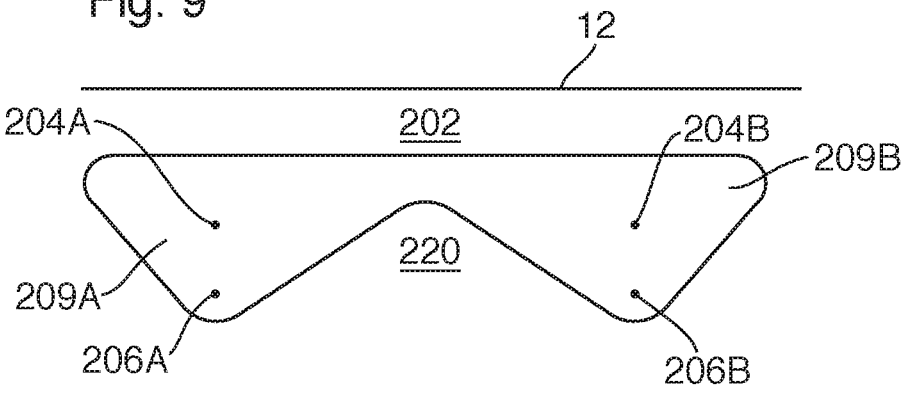
FIG. 9 is a schematic illustration of an intermediate reservoir region that is disposed between the steam chambers illustrated in FIG. 8.

For thermally-actuated gravity drainage-based processes implemented by both of the well paris 201A, 201B, the production-initiating fluid, being injected through the injection wells 204A, 204B, transfers heat to the hydrocarbon reservoir and effects heating of the bitumen. Although some of this bitumen becomes mobilized, some of it is not. Referring to FIG. 9, some of this bitumen may become stranded within an intermediate reservoir region 220 disposed between the communication domains 209A, 209B, and requires significant investment of heat energy to effect its recovery from this intermediate reservoir region 220. In some embodiments, for example, this intermediate reservoir region is referred to as a "bypassed region".

Figure 10:
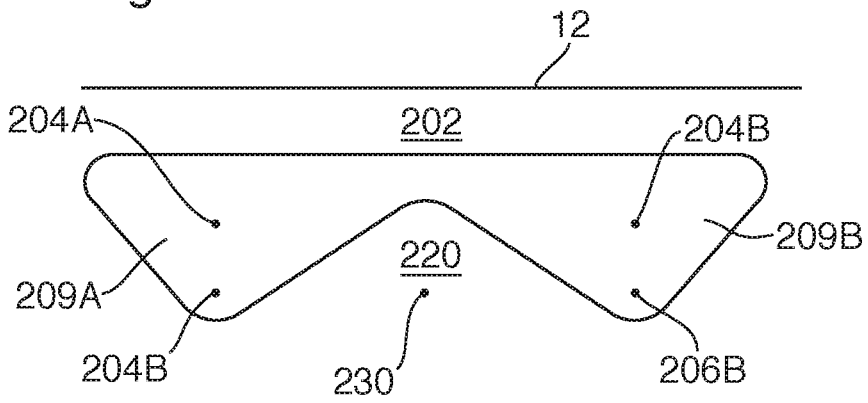
FIG. 10 is a schematic illustration of an infill well that has been positioned within the intermediate reservoir region illustrated in FIG. 9.
Figure 10A:
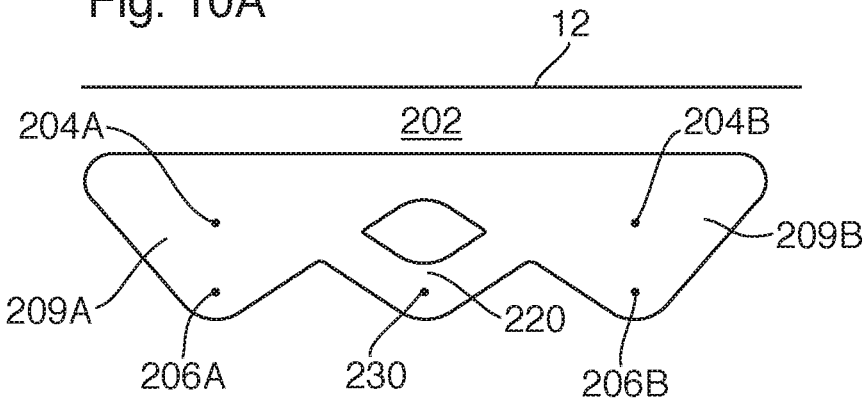
FIG. 10A is a schematic illustration of further development of the steam chambers illustrated in FIG. 8 such that the steam chambers have extended into the intermediate reservoir region illustrated in FIG. 9.

At least a portion of the intermediate reservoir region is heated by heat generated by:

(a) the thermally-actuated gravity drainage-based process being effected by the first well pair 201A, or (b) the thermally-actuated gravity drainage-based process being effected by the second well pair 201B, or (c) both of: (i) the thermally-actuated gravity drainage-based process being effected by the first well pair 201A, and (ii) the thermally-actuated gravity drainage-based process being effected by the second well pair 201B, It is desirable to recover the hydrocarbon material disposed within the flanking region. To do so, and referring to FIG. 10, after an early stage hydrocarbon production process (such as, for example, an early thermally-actuated gravity drainage-based process) has been being effected for a period of time, an infill well 230 is formed (in some embodiments, for example, the forming includes drilling) for receiving mobilized hydrocarbon material of at least the intermediate reservoir region 220, and for producing the received hydrocarbon material. In some embodiments, for example, the hydrocarbon material that is received by the infill well 230 is produced via the well 230 by artificial lift. In some embodiments, for example, the infill well 230 is formed after the early stage hydrocarbon production process has been suspended. In some embodiments, for example, the infill well 230 includes a respective horizontal section for receiving gravity drainage of hydrocarbon material whose mobilization has been effected by production-initiating fluid that has been injected via at least one of the injection wells 204A, 204B that is disposed above the infill well 230.

In some embodiments, for example, a later stage hydrocarbon production process may be implemented via the infill well 230. In some embodiments, for example, prior to the formation of the infill well 230, and up until at least the implementation of the a later stage hydrocarbon production process may be implemented via the infill well 230, the injecting of production-initiating fluid into the communication domain 209A is suspended.

In some embodiments, for example, the later-stage hydrocarbon production process may include cyclic steam simulation. In this respect, steam is injected into the intermediate reservoir region 220 via the infill well 230, time is provided for heat to be transferred to the hydrocarbon material in order to effect the viscosity reduction such that the hydrocarbon material becomes mobilized, and then the infill well 230 is converted to a production well and the mobilized hydrocarbon material is produced via the infill well 230.

In some embodiments, for example, the later-stage hydrocarbon production process may include SAGD. In such cases, once fluid communication is effected between at least one of the injection wells 204A 204B and the infill well 230 (such as by, for example, injecting steam into the intermediate reservoir region 220 so as to effect the sufficient mobilization of the hydrocarbon material within the flanking region such that interwell communication becomes effected between the at least one of the injection wells 204A, 204B and the infill well 230), steam is injected into the intermediate reservoir region 230 via the injection well 204A such that production of hydrocarbon material is effected by a combination of at least a drive mechanism and a gravity drainage mechanism. The continued injection of steam contributes to the development of a communication domain (or steam chamber) (as an extension of one or both of the communication domains 209A, 209B), much in the same way as the development of the communication domain 209A. It is understood that, as a necessary incident to some implementations of the process, hydrocarbon material may also become mobilized within one or both of the communication domains 209A, 209B, by the steam injected via the respective one of the injection wells 204A, 204B, and then conducted to the infill well 230 (by at least gravity drainage), and then produced via the infill well 230.

It is understood that the selection of the later-stage hydrocarbon production process is independent of the selection of the early stage hydrocarbon production process, and that the type of hydrocarbon production process implemented as the later-stage hydrocarbon production process may be the same as, or different than, the early stage hydrocarbon production process. For example, in some embodiments, the early stage hydrocarbon production process may be SAGD, while the later-stage hydrocarbon production process may be cyclic steam stimulation. Alternatively, in some embodiments, both of the early stage hydrocarbon production process and the later-stage hydrocarbon production process may be a SAGD process.

Figure 11:
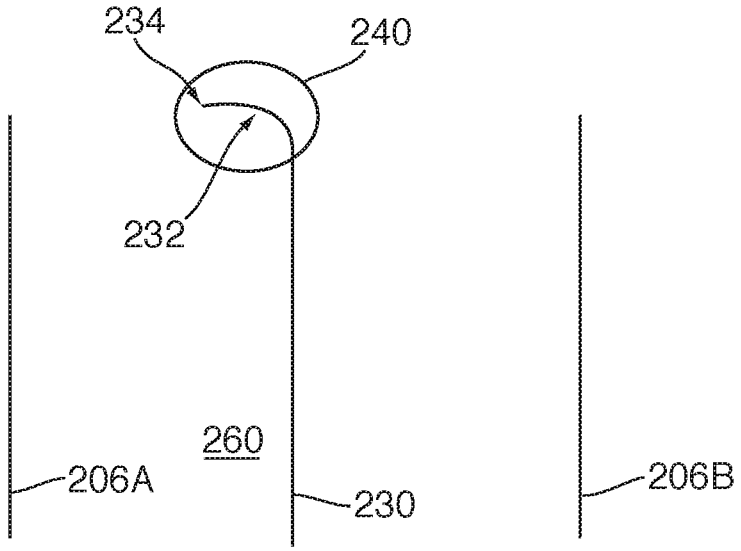
FIG. 11 is a plan view of the relative positioning of the infill well vis-à-vis the production wells of the SAGD well pairs of FIG. 7, illustrating disposition of the heat receiving portion of the infill well within a pre-selected zone.

Referring to FIG. 11, in forming the infill well 230, the infill well becomes positioned such that a pre-selected zone-disposed portion 232 of the infill well 230 is disposed within a pre-selected zone 240 within the reservoir 202. In some embodiments, for example, the positioning includes drilling. In some embodiments, for example, the positioning may include modification to, or extension of, a pre-existing well.

In some embodiments, for example, the pre-selected zone-disposed portion 232 of the infill well 230 is defined at, or substantially at, the toe 234 of the infill well 230. In some embodiments, for example, the pre-selected zone-disposed portion 232 of the infill well 230 is defined within a hook portion 236 of the infill well 230. In some embodiments, for example, the hook portion 230 is oriented in a direction towards the production well 206.

In some embodiments, for example, the selecting is based upon a plurality of temperature determinations, wherein each one of the temperature determinations is, independently, respective to one of a corresponding plurality of zones within the reservoir 202. In some embodiments, for example, the process further includes obtaining temperatures within each one of the plurality of zones within the reservoir 202.

In some embodiments, for example, the selecting is based upon a determination that the pre-selected zone 240 is disposed at a higher temperature than the other ones of the two or more zones within the reservoir 202. In some embodiments, for example, each one of the two or more zones, independently, is disposed externally of the communication domains 209A, 209B. In some embodiments, for example, each one of the two or more zones, independently, is disposed within the intermediate reservoir region 220. In some embodiments, for example, the infill well is disposed within the intermediate reservoir region 220. In some embodiments, for example, the process further includes sensing temperature within a plurality of zones within the reservoir 202 for effecting the determination that the pre-selected zone is disposed at a higher temperature than the other ones of the two or more zones.

In some embodiments, the pre-selected zone is selected from two or more zones within the reservoir 202, wherein the selecting is based upon a determination that the pre-selected zone has a rate of cooling that is slower than the other ones of the two or more zones. In some embodiments, for example, each one of the two or more zones, independently, is disposed externally of the communication domains 209A, 209B. In some embodiments, for example, each one of the two or more zones, independently, is disposed within the intermediate reservoir region 220. In some embodiments, for example, the infill well 230 is disposed within the intermediate reservoir region 220. In some embodiments, for example, the process further includes sampling for temperature fall-off data upon which the determination is based.

In some embodiments, for example, the selection of the pre-selected zone 240 is based upon temperature fall-off data of the first and second communication domains 209A, 209B. Temperature fall-off data may be obtained by shutting in both of the injection wells 204A, 204B such that each one of the communication domains 209A, 209B, independently, are permitted to cool. In some embodiments, for example, the disposition of the pre-selected zone-disposed portion 232 of the infill well 230 is within the intermediate reservoir region 220. In some embodiments, for example, the pre-selected zone 240 is selected externally of the communication domains 209A, 209B. In some embodiments, for example, the process further includes sampling for temperature fall-off data upon which the selecting is based.

In some embodiments, for example, the infill well 230 includes a horizontal section, and the pre-selected zone-disposed portion 232 is disposed within the horizontal section.

In some embodiments, for example, the selecting is such that, after the infill well portion 232 becomes disposed within the pre-selected zone 240, the pre-selected zone-disposed portion 232 of the infill well 230 is closer to a respective production well 206A, 206B of a one of the well pairs 201A, 201B than to a respective production well 206A, 206B of the other one of the well pairs 201A, 201B.

In some embodiments, for example, the selecting is such that the pre-selected zone-disposed portion 232 of the infill well 230 is spaced apart from a respective production well 206A, 206B of a one of the well pairs 201A, 201B by a minimum distance "D1" that is less than the minimum distance "D2" by which the pre-selected zone-disposed portion 232 of the infill well 230 is spaced apart from a respective production well 206A, 206B of the other one of the well pairs 201A, 201B by at least 10% of the minimum distance by which the pre-selected zone-disposed portion 232 of the infill well 230 is spaced apart from a respective production well 206A, 206B of the other one of the well pairs 201A, 201B.

Figure 12:
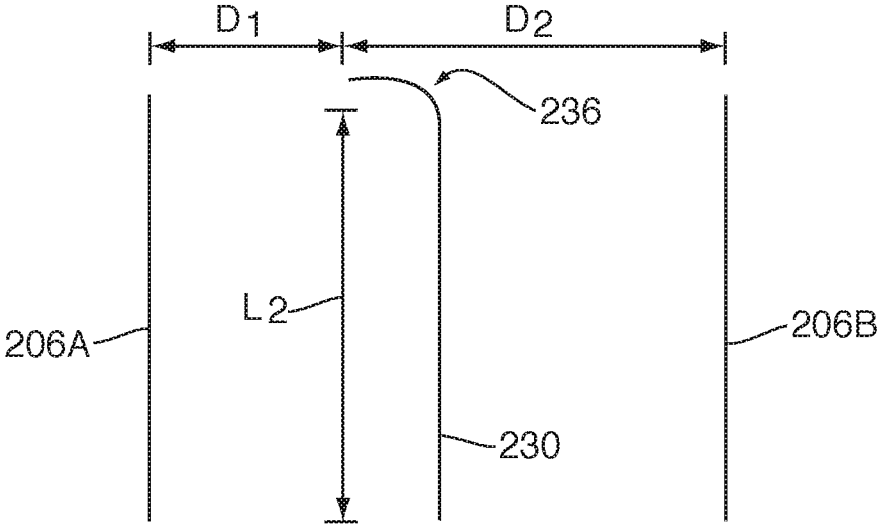
FIG. 12 is another plan view of the relative positioning of the infill well vis-à-vis the production wells of the SAGD well pairs of FIG. 7, illustrating disposition of the pre-selected zone-disposed portion of the infill well within a pre-selected zone, and further illustrating positioning of other portions of the infill well relative to the pre-selected zone-disposed portion.

Referring to FIG. 12, in some embodiments, for example, the selecting is such that, after the infill well portion 232 becomes disposed within the pre-selected zone 240, the pre-selected zone-disposed portion 232 of the infill well 230 is closer to a respective production well 204A, 204B, of one of the first and second well pairs 201A, 201B, than is at least 75% of the axial length "L2" (such as, for example, at least 90% of the axial length L2) of the horizontal section of the infill well 230. In some embodiments, for example, at least 75% of the axial length of the horizontal section of the infill well 230 that is other than the pre-selected zone-disposed portion 232 of the infill well 230, the minimum distance, by which each one of the portions of the at least 75% of the axial length of the horizontal section of the infill well 230, independently, is spaced apart from a respective production well 204A, 204B of one of the well pairs 201A, 201B, is greater than the minimum distance by which the pre-selected zone-disposed portion 232 of the infill well 230 is spaced apart from that production well by at least 10%, such as, for example, at least 25% such as, for example, at least 50%. It is understood that the at least 75% of the axial length of the horizontal section of the infill well 130 that is other than the pre-selected zone-disposed portion 232 of the infill well 230 may be a continuous sub-section or may include a plurality of spaced-apart sub-sections.

In some embodiments, for example, in being produced through the infill well 230, the hydrocarbon material is conducted via a wellbore fluid conductor, disposed within the infill well 230, to the surface. In this respect, the wellbore fluid conductor functions to effect conduction of heat from the pre-selected zone 240 to a heat receiving zone 260 of the intermediate reservoir region 220. In some embodiments, for example, heat communicated from the pre-selected zone 140, and received by the wellbore fluid conductor, that is disposed within the infill well 130, sufficiently contributes to the heating of a heat receiving zone 260 of the intermediate reservoir region 220.

In this respect, in some embodiments, for example, the selecting is based upon a determination that, after the infill well portion 232 becomes disposed within the pre-selected zone 240, sufficient heat is communicated from the pre-selected zone 240, via the infill well 230, for at least contributing to the heating of one or more heat receiving zones 260 of the intermediate reservoir region 220 such that hydrocarbon material within the intermediate reservoir region 220 becomes mobilized in the absence of heat communicated from fluid injected into the intermediate reservoir region 220 after the infill well portion 232 becomes disposed within the pre-selected zone 240. In some embodiments, for example, the absence of heat communicated from fluid injected into the intermediate reservoir region 220, after the infill well portion 232 becomes disposed within the pre-selected zone 240, includes the absence of heat communicated from fluid injected into the intermediate reservoir region 220 via the infill well 230.

On the other hand, in some embodiments, for example, prior to producing hydrocarbon material with the later-stage hydrocarbon production process, additional heating of the intermediate reservoir region 220 may be necessary to effect mobilization of hydrocarbon material within the intermediate reservoir region 220, and, in some of these embodiments (such as in those embodiments where it is intended to implement a thermally-actuated gravity drainage-based hydrocarbon production process), effect interwell communication between the infill well 230 and one or both of the injection wells 204A, 204B, and thereby extend one or both of the communication domains 109A, 109B into the intermediate reservoir region 220. In this respect, in some embodiments, for example, the heating may be effected by injecting heating fluid (such as a production-initiating fluid) into the intermediate reservoir region via the infill well 230.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A hydrocarbon production process comprising:

operating an early stage hydrocarbon production process with a first well pair within a reservoir, wherein the early stage hydrocarbon production process includes injecting a production-initiating fluid via an injection well of the first well pair into a communication domain such that hydrocarbon material is mobilized and conducted to a production well of the first well pair, and producing the mobilized hydrocarbon, that has been received by the production well, via the production well;

selecting a pre-selected zone within the reservoir based upon temperature fall-off data within the communication domain; and positioning a portion of an infill well within the pre-selected zone for receiving mobilized hydrocarbon material of at least a flanking region, that is spaced apart from and flanking the communication domain, and for producing the received hydrocarbon material.

2. The hydrocarbon production process as claimed in claim 1, further comprising:

sampling for temperature fall-off data upon which the selecting is based.

3. The hydrocarbon production process as claimed in claim 1;

wherein the pre-selected zone is selected externally of the communication domain.

4. The hydrocarbon production process as claimed in claim 1;

wherein the pre-selected zone is selected from within the flanking region.

5. The hydrocarbon production process as claimed in claim 1;

wherein the infill well includes a horizontal section, and wherein the pre-selected zone-disposed portion is disposed within the horizontal section;

wherein the selecting is such that, after the infill well portion becomes disposed within the pre-selected zone, the pre-selected zone-disposed portion of the infill well is closer to the production well than is at least 75% of the other portions of the horizontal section of the infill well; and wherein for at least 75% of the axial length of the horizontal section of the infill well that is other than the pre-selected zone-disposed portion of the infill well, the minimum distance, by which each one of the portions of the at least 75% of the axial length of the horizontal section of the infill well, independently, is spaced apart from the production well, is greater than the minimum distance by which the pre-selected zone-disposed portion of the infill well is spaced apart from the production well by at least 10%.

6. The hydrocarbon production process as claimed in claim 1;

wherein the pre-selected zone-disposed portion of the infill well is defined within a hook portion of the infill well, wherein the hook portion is oriented in a direction towards the production well.

7. A hydrocarbon production process comprising:

operating an early stage hydrocarbon production process with a first well pair within a reservoir, wherein the early stage hydrocarbon production process includes injecting a first production-initiating fluid via an injection well of the first well pair into a communication domain such that hydrocarbon material is mobilized and conducted to a production well of the first well pair, and producing the mobilized hydrocarbon, that has been received by the production well, via the production well;

selecting a pre-selected zone from two or more zones within the reservoir, wherein the selecting is based upon a determination that the pre-selected zone has a rate of cooling that is slower than the other ones of the two or more zones; and positioning a portion of an infill well within the pre-selected zone for receiving mobilized hydrocarbon material of at least a flanking region, that is spaced apart from and flanking the communication domain, and for producing the received hydrocarbon material.

8. The hydrocarbon production process as claimed in claim 7;

wherein each one of the two or more zones, independently, is disposed externally of the communication domain.

9. The hydrocarbon production process as claimed in claim 7;

wherein each one of the two or more zones, independently, is disposed within the flanking region.

10. The hydrocarbon production process as claimed in claim 9;

wherein the infill well is disposed within the flanking region.

11. The hydrocarbon production process as claimed in claim 7, further comprising:

sampling for temperature fall-off data upon which the determination is based.

12. The hydrocarbon production process as claimed in claim 7;

wherein the infill well includes a horizontal section, and wherein the pre-selected zone-disposed portion is disposed within the horizontal section;

wherein the selecting is such that, after the infill well portion becomes disposed within the pre-selected zone, the pre-selected zone-disposed portion of the infill well is closer to the production well than is at least 75% of the other portions of the horizontal section of the infill well; and wherein for at least 75% of the axial length of the horizontal section of the infill well that is other than the pre-selected zone-disposed portion of the infill well, the minimum distance, by which each one of the portions of the at least 75% of the axial length of the horizontal section of the infill well, independently, is spaced apart from the production well, is greater than the minimum distance by which the pre-selected zone-disposed portion of the infill well is spaced apart from the production well by at least 10%.

13. The hydrocarbon production process as claimed in claim 7;

wherein the pre-selected zone-disposed portion of the infill well is defined within a hook portion of the infill well, wherein the hook portion is oriented in a direction towards the production well.

14. A hydrocarbon production process comprising:

operating an early stage hydrocarbon production process with a first well pair within a reservoir, wherein the early stage hydrocarbon production process includes injecting a first production-initiating fluid via an injection well of the first well pair into a communication domain such that hydrocarbon material is mobilized and conducted to a production well of the first well pair, and producing the mobilized hydrocarbon, that has been received by the production well, via the production well;

selecting a pre-selected zone from two or more zones within the reservoir, wherein the selecting is based upon a determination that the pre-selected zone is disposed at a higher temperature than the other ones of the two or more zones; and positioning a portion of an infill well within the pre-selected zone for receiving mobilized hydrocarbon material of at least a flanking region, that is spaced apart from and flanking the communication domain, and for producing the received hydrocarbon material.

15. The hydrocarbon production process as claimed in claim 14;

wherein each one of the two or more zones, independently, is disposed externally of the communication domain.

16. The hydrocarbon production process as claimed in claim 14;

wherein each one of the two or more zones, independently, is disposed within the flanking region.

17. The hydrocarbon production process as claimed in claim 16;

wherein the infill well is disposed within the flanking region.

18. The hydrocarbon production as claimed in claim 14, further comprising:

sensing temperature within a plurality of zones within the reservoir for effecting the determination that the pre-selected zone is disposed at a higher temperature than the other ones of the two or more zones.

19. The hydrocarbon production process as claimed in claim 14;

wherein the infill well includes a horizontal section, and wherein the pre-selected zone-disposed portion is disposed within the horizontal section;

wherein the selecting is such that, after the infill well portion becomes disposed within the pre-selected zone, the pre-selected zone-disposed portion of the infill well is closer to the production well than is at least 75% of the other portions of the horizontal section of the infill well; and wherein for at least 75% of the axial length of the horizontal section of the infill well that is other than the pre-selected zone-disposed portion of the infill well, the minimum distance, by which each one of the portions of the at least 75% of the axial length of the horizontal section of the infill well, independently, is spaced apart from the production well, is greater than the minimum distance by which the pre-selected zone-disposed portion of the infill well is spaced apart from the production well by at least 10%.

20. The hydrocarbon production process as claimed in claim 14;

wherein the pre-selected zone-disposed portion of the infill well is defined within a hook portion of the infill well, wherein the hook portion is oriented in a direction towards the production well.

* * * * *